US006758141B1

(12) United States Patent
Jentzsch et al.

(10) Patent No.: US 6,758,141 B1
(45) Date of Patent: Jul. 6, 2004

(54) METHOD AND APPARATUS FOR THE RETENTION OF INK PROFILE FOR PRINTING

(75) Inventors: Arndt Jentzsch, Coswig (DE); Uwe Becker, Radebeul (DE)

(73) Assignee: Koenig & Bauer AG, Wurzburg (DE)

( * ) Notice: Subject to any disclaimer, the term of this patent is extended or adjusted under 35 U.S.C. 154(b) by 0 days.

(21) Appl. No.: 09/364,403

(22) Filed: Jul. 30, 1999

(30) Foreign Application Priority Data

Aug. 1, 1998 (DE) ..... 198 34 784

(51) Int. Cl.[7] ..... B41F 31/00
(52) U.S. Cl. ..... 101/484; 101/352.01
(58) Field of Search ..... 101/335, 350.1, 101/351.1, 352.01, 483, 484, 337, 352, 357, 143, 343, 346, 349, 492

(56) References Cited

U.S. PATENT DOCUMENTS

| | | | | |
|---|---|---|---|---|
| 1,926,145 A | | 9/1933 | Erickson et al. | |
| 2,545,836 A | * | 3/1951 | A.J Albrecht | 101/137 |
| 3,473,468 A | | 10/1969 | Vandeman et al. | |
| 3,638,568 A | * | 2/1972 | Granger | 101/219 |
| 4,000,692 A | * | 1/1977 | Wirz et al. | 101/144 |
| 4,423,737 A | | 1/1984 | Yano et al. | |
| 4,896,601 A | * | 1/1990 | Jeschke | 101/350 |
| 5,010,820 A | * | 4/1991 | Loffler | 101/484 |
| 5,113,761 A | * | 5/1992 | Okamura | 101/350 |
| 5,148,747 A | * | 9/1992 | Rodi et al. | 101/450 |
| 5,174,210 A | * | 12/1992 | Rodi et al. | 101/492 |
| 5,191,835 A | * | 3/1993 | Blanchard | 101/148 |
| 5,388,514 A | * | 2/1995 | Eltner | 101/352 |
| 5,447,102 A | | 9/1995 | Pfeiffer et al. | |
| 5,588,362 A | * | 12/1996 | Sugiyama et al. | 101/218 |
| 5,626,077 A | | 5/1997 | Muller | |
| 5,743,183 A | * | 4/1998 | Hummel et al. | 101/147 |
| 5,845,576 A | | 12/1998 | Junghans | |
| 5,983,793 A | * | 11/1999 | Volz et al. | 101/216 |
| 6,349,643 B1 | | 2/2002 | Loftus et al. | |

FOREIGN PATENT DOCUMENTS

| | | |
|---|---|---|
| DE | 472544 | 2/1929 |

* cited by examiner

*Primary Examiner*—Ren Yan
(74) *Attorney, Agent, or Firm*—Goodwin Procter LLP

(57) ABSTRACT

The invention is a method for retaining an ink profile established during ink infeed, for printing in an inking unit of a printing press containing a drive for the inking unit, an ink dosing device, and a roller group in the inking unit having oscillating rollers and transfer rollers, by delaying printing after ink infeed by interrupting the drive to the inking unit for a time period between the end of ink infeed and delayed printing; and to apparatus for effectuating such drive interruption.

8 Claims, 2 Drawing Sheets

PY

METHOD AND APPARATUS FOR THE RETENTION OF INK PROFILE FOR PRINTING

FIELD OF THE INVENTION

The invention relates to a method and an apparatus for retention of an ink profile for the printing in the inking unit of printing presses.

BACKGROUND OF THE INVENTION

A method for a defined generation of an ink distribution required for the printing in an inking unit of a rotary printing press is known e.g. from German patent No. 3,707,695 C2. By this method an existing ink profile is relaxed and an ink profile required for the subsequent printing job is established, or an ink profile is created in an inking unit running without ink. After the required ink profile for this subsequent printing job is set, paper travel and the printing process in the press are initiated, or the ink duct movement is switched off, or the ink duct movement is switched off and the press is stopped.

If the printing process does not start immediately, it is a disadvantage that the so set ink profile is evened out to a basic ink layer.

SUMMARY DESCRIPTION OF THE INVENTION

The object of the present invention is to provide a method and apparatus for retention of an ink profile for the printing.

This object is realized by the method and apparatus for retaining an ink profile established during the ink infeed process for printing in inking units of printing presses containing ink dosing equipment, and a roller group with oscillating rollers, transfer rollers, and inking rollers, which interrupts the drive of the inking unit for the duration from the end of ink infeed to the delayed start of printing.

BRIEF DESCRIPTION OF THE DRAWING

The invention is described below in greater detail by an embodiment of the invention, by reference being had to the drawing, wherein.

DETAILED DESCRIPTION

The method for retaining an ink profile for printing in accordance with the present invention can be employed in a printing press with at least one printing unit.

Figure 1:
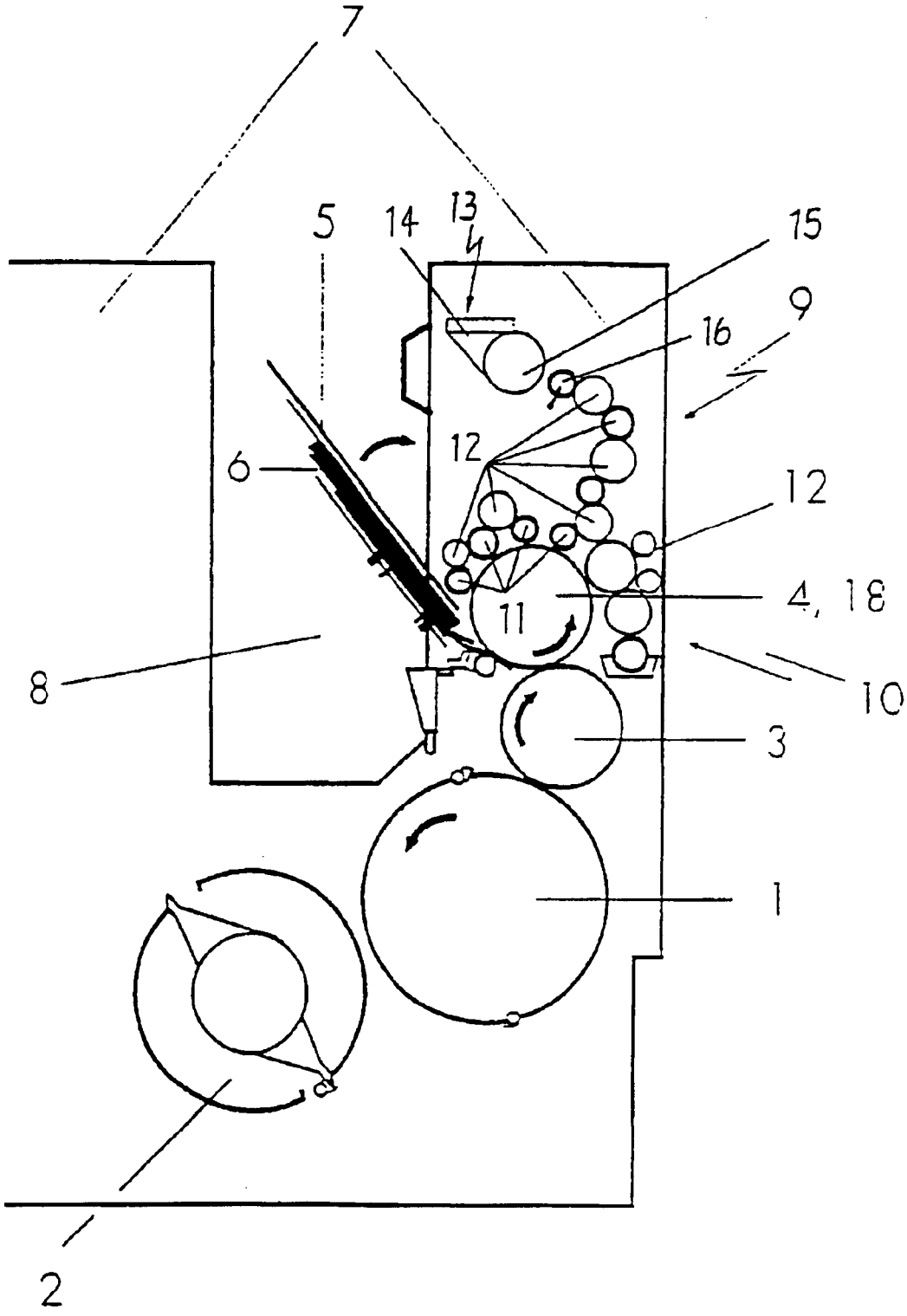
FIG. 1 is a schematic illustration of a printing unit.

FIG. 1 shows a printing unit 7 of a printing press with conventional sheet travel past one impression cylinder 1 and one transfer drum 2. The impression cylinder 1 is connected with the blanket cylinder 3 which is in operating connection with the plate cylinder 4. The plate cylinder 4 carries a printing plate 5.

The printing plate 5 is fed to the plate cylinder 4 by a cassette 6 containing all elements for acceptance of the printing plate 5, its transportation from the cassette to the plate cylinder 4, as well as elements for acceptance of the finished printing plate S from the plate cylinder 4, transportation of the printing plate 5 into the cassette 6 and for reception of the printing plate 5 in the cassette 6.

FIG. 1 shows the cassette 6 in the plate changing position. For this purpose the cassette 6 is turned away from the printing unit 7 and projects into the walkway 8 between two neighbored printing units 7. The cassette 6 is turned in the direction of the arrow toward the printing unit 7 if not in use and serves as safety guard in its vertical position.

The printing plate 5 is mounted on the plate cylinder 4 and for the inking of the printing plate 5 in an operational connection with an inking unit 9 and a dampening unit. 10. The inking unit 9 contains conventional inking rollers 11 in operational connection with the plate cylinder 4, transfer rollers 12 and a ink dosing device 13 for delivery of ink from an ink tray 14 to one of the transfer rollers 12.

Figure 2:
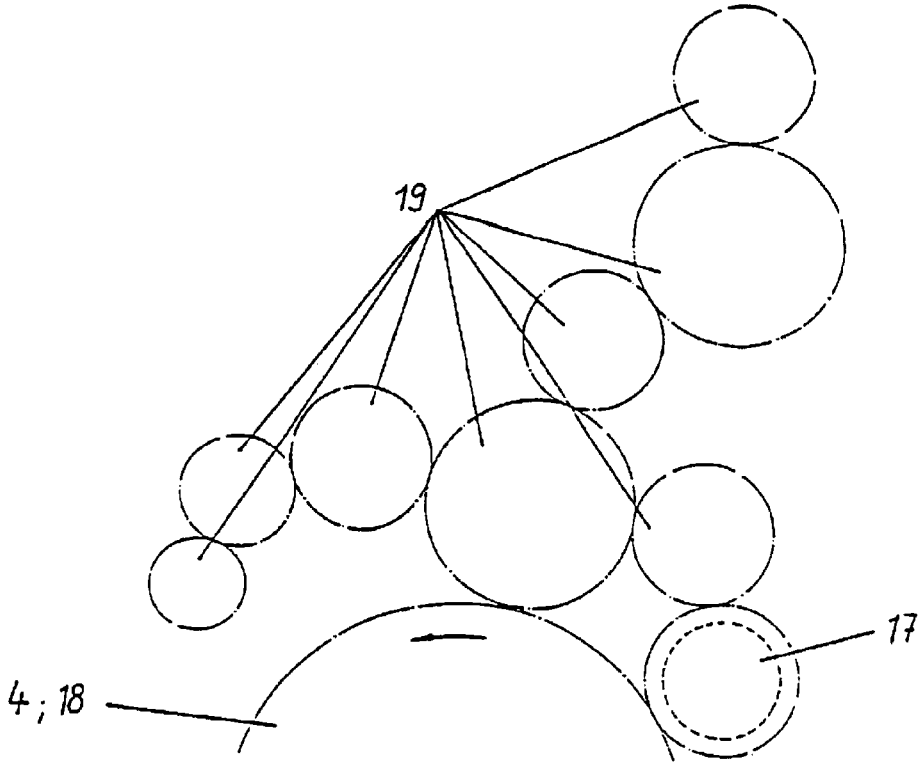
FIG. 2 is a schematic illustration of a gear train plate cylinder-linking unit.

The ink dosing device 13 contains an ink tray 14, an ink ball 15 and an ink duct 16 swinging between the ink ball 15 and one of the transfer rollers 12. The inking unit 9 is usually driven by an inking unit drive gear 17 (FIGS. 2,3) which is connected on one side with the gear 18 of the plate cylinder 4 and on the other side with the gear train 19 of the inking unit 9. The drive movement of the inking unit 9 respectively of the driven rollers of the inking unit 9 and the movement of the ink duct 16 are usually derived from the inking unit drive gear 17. The ink ball 15 is mostly driven separately by a motor.

Figure 3:
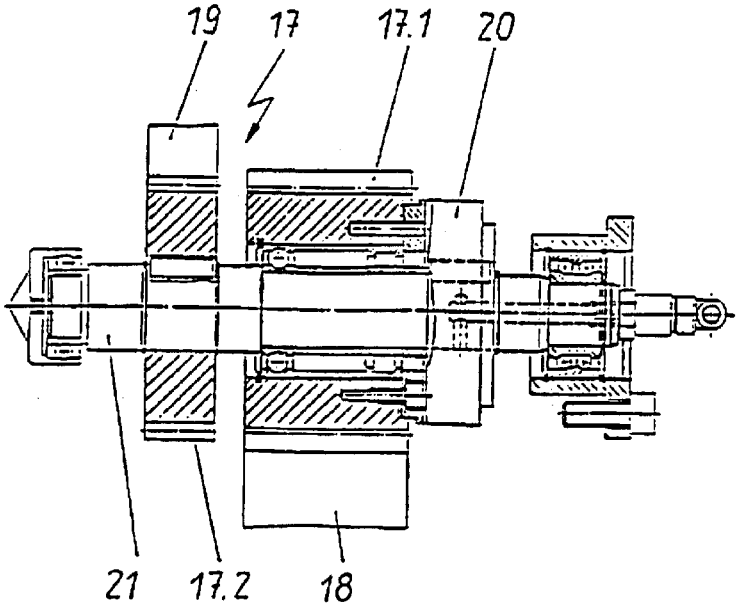
FIG. 3 is a cross-sectional view of a drive system.

FIG. 3 shows the embodiment of the inking unit drive gear 17 geared with the gear 18 of the plate cylinder 4 as a twin gears 17.1 and 17.2. The first gear 17.1 of the inking unit drive 17 is connected by a switchable clutch 20 with the shaft 21 of the inking unit drive gear 17. The shaft 21 carries also the second gear 17.2 connected to the gear train 19 of the inking unit 9. The inking unit 9 can thus be separated from the drive of the printing unit 7 by disengagement of the clutch 20, i.e. the inking unit 9 stands still during rotation of the cylinder group (of the plate cylinder, blanket cylinder, impression cylinder, and transfer drum). The engagement and disengagement of the inking unit 9 is done in phase correct synchronization to the printing press, i.e. in a defined position of the plate cylinder.

The set ink profile is retained until the start of the printing process through the standstill either totally or partially of the inking unit 9, with a continued possibility of running the printing press until the start of the printing, i.e. resting of the ink dosing equipment 13 including the roller group, or only the roller group including the ink duct, or only the roller group. Standstill of the inking unit 9 is also advisable during stoppages of the printing press to retain the respective ink profile.

I claim:

1. A method for retaining an ink profile established during ink infeed for printing in an inking unit of a printing press, said printing press comprising:
- said inking unit; and
- at least one printing unit;

said inking unit comprising:
- a drive for said inking unit;
- an ink dosing device; and
- a roller group having transfer rollers;

said method comprising delaying printing after said ink infeed by interrupting said drive for said inking unit after said ink infeed until delayed printing starts.

2. The method of claim 1, wherein said interrupting takes place in phase correct synchronization with said printing press.

3. The method of claim 1, wherein said interrupting is done by disengaging said drive for said inking unit with said at least one printing unit.

4. The method of claim 1, further comprising continuing printing after said interrupting.

5. The method of claim 4, wherein said continuing printing comprising engaging said drive for said inking unit with said at least one printing unit.

6. The method of claim 5, wherein said engaging takes place in phase correct synchronization with said printing press.

7. The method of claim 1, wherein said drive for said inking unit is interrupted while said printing press is running.

8. The method of claim 1, wherein said drive for said inking unit is interrupted during a stoppage of said printing press.

* * * * *